United States Patent [19]

Machida et al.

[11] Patent Number: 4,963,157

[45] Date of Patent: Oct. 16, 1990

[54] METHOD FOR BLEACHING CELLULOSIC FIBER MATERIAL WITH HYDROGEN PEROXIDE

[75] Inventors: Osamu Machida, Tokyo; Tsutomu Yoshida, Fukui; Norio Kimura, Sakai; Masatoshi Watanabe, Adachi, all of Japan

[73] Assignees: Nippon Peroxide Co., Ltd., Tokyo; Nikka Chemical Co., Ltd., Fukui, both of Japan

[21] Appl. No.: 275,638

[22] Filed: Nov. 22, 1988

Related U.S. Application Data

[63] Continuation-in-part of Ser. No. 40,531, Apr. 17, 1987, abandoned.

[51] Int. Cl.[5] ..... D06L 3/14

[52] U.S. Cl. ..... 8/111; 8/149.3

[58] Field of Search ..... 8/111, 149.3, 111

[56] References Cited

U.S. PATENT DOCUMENTS

| | | | |
|---|---|---|---|
| 3,122,417 | 2/1964 | Blaser et al. | 252/174.23 |
| 3,663,448 | 5/1972 | Ralston | 252/180 |
| 3,699,048 | 10/1972 | Krueger et al. | 252/180 |
| 3,740,187 | 6/1973 | Kowalski | 252/95 X |
| 3,860,391 | 1/1975 | Kling et al. | 252/174.23 |
| 3,957,428 | 5/1976 | Massey et al. | 8/111 |
| 4,079,015 | 3/1978 | Paucot et al. | 252/95 |
| 4,110,242 | 8/1978 | Hase et al. | 252/184.29 |
| 4,115,309 | 9/1978 | Krause et al. | 252/174.23 |
| 4,363,699 | 12/1982 | DeCeuster et al. . | |
| 4,379,080 | 4/1983 | Murphy | 252/526 |
| 4,403,994 | 9/1983 | Hignett | 252/174.23 |
| 4,450,089 | 5/1984 | Broze et al. | 252/174.23 |
| 4,455,249 | 6/1984 | Broze et al. | 252/174.23 |
| 4,457,760 | 7/1984 | Cholley | 8/111 |
| 4,539,130 | 9/1985 | Thompson et al. | 252/186.29 |
| 4,614,646 | 9/1986 | Christiansen | 252/186.29 X |

*Primary Examiner*—John S. Maples
*Assistant Examiner*—Valerie D. Fee
*Attorney, Agent, or Firm*—McAulay Fisher Nissen & Goldberg

[57] ABSTRACT

A method of bleaching a cellulosic fiber material with hydrogen peroxide, comprising:

(a) impregnating a cellulosic fiber material with an aqueous bleaching solution containing hydrogen peroxide and a stabilizer comprising:

(i) 1 to 100 parts by weight of at least one hydroxyacrylic acid polymer selected from the group consisting of poly-α-hydroxyacrylic acids, and salts thereof and polylactone corresponding thereto; and (ii) 1 to 50 parts by weight of at least one organic phosphate acid compound selected from the group consisting of methylene,1,1-diphosphonic acid, ethylidene-1,1-diphosphonic acid, butylidene-1,1-disphosphonic acid, 1-hydroxyethylidene-1,1-diphosphonic acid, 1-hydroxypropylidene-1,1-diphosphonic acid, amino-tri(methylenephosphonic acid), hexamethylene diamine tetra(methylenephosphonic acid), triethylenetetramine hexa(methylenephosphonic acid), and salts of the above-mentioned organic phosphonic acids, and (b) heating the impregnated cellulosic fiber material with steam.

5 Claims, No Drawings

METHOD FOR BLEACHING CELLULOSIC FIBER MATERIAL WITH HYDROGEN PEROXIDE

This application is a continuation-in-part, of application Ser. No. 07/040,531, filed Apr. 17, 1987 now abandoned.

BACKGROUND OF THE INVENTION

1. Field of the Invention

The present invention relates to a method for bleaching cellulose fiber material with hydrogen peroxide. More particularly, the present invention relates to the aforesaid method in which a stabilizer for hydrogen peroxide in an aqueous bleaching solution for bleaching fiber materials.

2. Description of the Related Art

It is known that a bleaching process using hydrogen peroxide as a bleaching agent is carried out under an alkaline condition. However, it is also known that, under the alkaline condition, if the bleaching solution contains a heavy metal, for example, iron, copper or manganese, hydrogen peroxide in the bleaching solution is decomposed to a certain extent, due to the undesirable influence of the heavy metal, in accordance with the following chemical reaction:

$$2H_2O_2 \rightarrow 2H_2O + O_2$$

the above-mentioned phenomenon hinders the production of perhydroxyl ions ($OOH^-$), which make a large contribution to the bleaching effect of hydrogen peroxide, in accordance with the following reaction:

$$H_2O_2 \rightarrow H^+ + OOH^-$$

and results in an undesirable decrease in the bleaching effect of hydrogen peroxide.

Usually, the above-mentioned undesirable decomposition of hydrogen peroxide into molecular oxygen is prevented by adding a stabilizer to the hydrogen peroxide-containing bleaching solution. A well-known conventional stabilizer for the hydrogen peroxide bleach is sodium silicate, which exhibits an excellent stabilizing effect and allows fiber materials having an excellent whiteness to be produced. However, sodium silicate is disadvantageous in that it causes water-insoluble silicate compounds to be produced in the bleaching solution, which are deposited in the form of scales not only on the surface of the bleached fiber material but also on a bleaching apparatus, and thus degrade the touch of the bleached fiber material and the function of the bleaching apparatus. As other stabilizers for the hydrogen peroxide bleach, organic chelating agents, for example, ethylenediamine tetraacetic acid (EDTA) and diethylenetriamine pentaacetic acid (DTPA), and inorganic chelating agents, for example, polyphosphates, are disclosed in "MOL", No. 4, page 42, 1968, and water-soluble protein substances, for example, soybean protein and casein, are disclosed in Japanese Examined Patent Publication No. 50-34675 (1975).

The above-mentioned stabilizers different from sodium silicate exhibit a certain stabilizing intensity and an industrial usefulness when used in a batch type bleaching systems at a large liquor ratio. However, these stabilizers are disadvantageous in that, when used in a continuous bleaching system at a relatively small liquor ratio, the resultant hydrogen peroxide-stabilizing effect, whiteness of the bleached fiber material, prevention of degradation of the bleached fiber material, and process stability are poorer than those of sodium silicate. Accordingly, the above-mentioned conventional stabilizers other than sodium silicate do not satisfy the requirements of the bleach industry.

Japanese Unexamined Patent Publication No. 52-103,386 (1977) discloses that a bleaching stabilizer consisting of a poly(sodium-α-hydroxyacrylate) exhibits an excellent stabilizing effect, whiteness-increasing effect, and other effects, at a very high level, which could not be obtained by the conventional stabilizer. That is the poly(sodium-α-hydroxyacrylate) exhibits an excellent stabilizing effect for the hydrogen peroxide bleach and inhibition of the decomposition of hydrogen peroxide due to the presence of a hydrogen peroxide-decomposing catalyst, for example, heavy metals, at a high level comparable to those of sodium silicate. Also, it has been found that the poly(sodium-α-hydroxyacrylate) provides an excellent protection of the fiber materials from the degradative action of the bleaching agent. However, it has been further found that the stabilizing effect of the poly(sodium-α-hydroxyacrylate) is excessively high, and thus sometimes restricts the bleaching effect and cotton seed-removing effect of the hydrogen peroxide.

Furthermore, the poly(sodium-α-hydroxyacrylate) is very expensive and, therefore, if a stabilizer consisting of this compound alone is used in a necessary amount for exhibiting a desired bleaching effect, the bleaching process becomes extremely costly, and thus cannot be industrially utilized. In order to avoid the above-mentioned disadvantages, Japanese Unexamined Patent Publication No. 55-76161 (1980) discloses an improved hydrogen peroxide bleaching process in which a composite stabilizer consisting of a poly(sodium-α-hydroxyacrylate) combined with a polyphosphate is used. However, this type of composite stabilizer is disadvantageous in that the resultant bleached fiber material exhibits an unsatisfactory touch and is not preferable for industrial use.

Also, attempts have been made to use a composite stabilizer consisting of a poly(sodium-α-hydroxyacrylate) combined with sodium silicate. However, the results obtained by usage of the composite stabilizer were not satisfactory.

SUMMARY OF THE INVENTION

The invention primarily consists in a method of bleaching a cellulosic fiber materialwith hydrogen peroxide, comprising:

(a) impregnating a cellulosic fiber material with an aqueous bleaching solution containing hydrogen peroxide and a stabilizer comprising:

(i) 1 to 100 parts by weight of at least one hydroxyacrylic acid polymer selected from the group consisting of poly-α-hydroxyacrylic acids, and salts thereof and polylactone corresponding thereto; and (ii) 1 to 50 parts by weight of at least one organic phosphate acid compound selected from the group consisting of methylene,1,1-diphoshonic acid, ethylidene-1,1-diphosphonic acid, butylidene-1,1-disphosphonic acid, 1-hydroxyethylidene-1,1-diphosphonic acid, 1-hydroxypropylidene-1,1-diphosphonic acid, amino-tri(methylenephosphonic acid), hexamethylene diamine tetra(methylenephosphonic acid), triethylenetetramine hexa(methylenephosphonic acid), and salts of the above-mentioned organic phosphonic acids, and (b) heating the impregnated cellulosic fiber material with steam.

An object of the present invention is to provide a stabilizer for hydrogen peroxide bleach which exhibits an excellent bleaching effect superior to that obtained when using a conventional bleaching agent consisting of a poly(sodium-α-hydroxyacrylate) alone or sodium silicate alone, even when used in a continuous bleaching process at a small liquor ratio.

Another object of the present invention is to provide a stabilizer for hydrogen peroxide bleach which does not cause an undesirable formation of scales on the bleached fiber material and on the bleaching apparatus.

Still another object of the present invention is to provide a stabilizer for hydrogen peroxide bleach which makes a large contribution to the industrial production of a bleached fiber material having an enhanced high whiteness and a satisfactory touch, at a reduced cost.

A further object of the present invention is to provide a stabilizer for hydrogen peroxide bleach which exhibits an excellent restriction of the decomposition of hydrogen peroxide due to a decomposition catalyst, for example, heavy metals, a superior cotton seed-eliminating effect, and enhanced protection of the fiber material.

The aforesaid objects are attained by providing a method for bleaching a cellulosic fiber material with hydrogen peroxide, comprising:

(a) impregnating a cellulosic fiber material with an aqueous bleaching solution containing hydrogen peroxide and a stabilizer, comprising:

(i) at least one hydroxyacrylic acid polymer selected from the group consisting of poly-α-hydroxyacrylic acid, and salts thereof and polylactone corresponding thereto; and (ii) at least one organic phosphonic acid selected from the group consisting of methylene-1,1-diphosphonic acid, ethylidene-1,1-diphosphonic acid, butylidene-1,1-diphosphonic acid, 1-hydroxyethylidene-1,1-diphosphonic acid, 1-hydroxypropylidene-1,1-diphosphonic acid, and compounds of the formula (I):

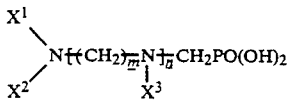

(I)

wherein $X^1$, $X^2$ and $X^3$ respectively represent, independently from each other, a member selected from the group consisting of a hydrogen atom and a methylene phosphonic acid radical, when one of $X^1$ and $X^2$ represents a hydrogen atom, the other one of $X^1$ and $X^2$ representing a methylenephosphonic acid radical, m represents an integer of from 1 to 15 and n represents zero or an integer of from 1 to 4, and salts of the above-mentioned organic phosphonic acids, and (b) heating the impregnated cellulosic fiber material with steam.

A feature of the invention is to provide the stabilizer in the aqueous bleaching solution is in an amount of 0.25 to 15 g/l.

A further feature of the invention is to provide the poly-α-hydroxyacrylic acids in the stabilizer have a molecular weight of from 1,000 to 1,000,000.

Another feature of the invention is to provide that the poly-α-hydroxyacrylic acid salts in the stabilizer are selected from monovalent metal salts and ammonium salts thereof.

A further feature of the invention is to provide that the salts of organic phosphonic acids in the stabilizer are selected from monovalent metal salts and ammonium salts thereof.

Another feature of the method is to provide that the organic phosphonic acids of the formula (I) in the stabilizer are selected from amino-tri(methylenephosphonic acid), ethylene-diaminetetra(methyklenephosphonic acid), diethylenetriaminepenta-(methylenephosphonic acid, and triethylenetetraminehexa(methylenephosphonic acid.

Yet another feature of the invention is to provide that the hydroxyacrylic polymer component (i) and the organic phoshonic acid component (ii) in the stabilizer are in a mixing weight ratio of 100:1 to 1:50.

Also within the scope of the invention is the use of a stabilizer of hydrogen peroxide bleach, which comprises:

(A) at least one hydroxyacrylic polymer selected from the group consisting of poly-α-hydroxyacrylic acids, and salts thereof and corresponding polylactones thereto; and (B) at least one organic phosphonic acid compound selected from the group consisting of those of the formulae (1) and (2):

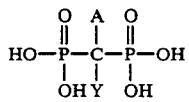

(1)

and

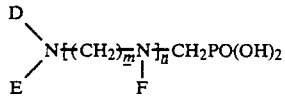

(2)

wherein A and Y respectively represent, independently from each other, a member selected from the group consisting of a hydrogen atom and alkyl radicals having 1 to 3 carbon atoms, D, E and F respectively represent, independently from each other, a member selected from the group consisting of a hydrogen atom and a methylenephosphonic acid radical, when one of D and E represents a hydrogen atom, the other one of D and E representing a methylenephosphonic acid radical, m represents an integer of from 1 to 15 and n represents zero or an integer of from 1 to 4, and salts of the above-mentioned organic phosphonic acids.

DESCRIPTION OF THE PREFERRED EMBODIMENTS

The inventors of the present invention discovered that, when a hydroxyacrylic acid polymer component (A) consisting of at least one hydroxyacrylic acid polymer selected from poly-α-hydroxyacrylic acids and salts thereof and corresponding polylactones thereto was combined with an organic phosphonic acid component (Y) consisting of at least one organic phosphonic acid compound selected from those of the formulae (1) and (2) and salts thereof, the resultant stabilizer exhibited an enhanced hydrogen peroxide-stabilizing effect, bleach-promoting effect, cotton seed-removing effect, and fiber material-protecting effect without forming undesirable scales on the fiber material, and is useful for producing bleached fiber materials having an enhanced whiteness and a satisfactory touch. The grounds for the attainment of the excellent effects of the stabilizer of the present invention are not absolutely clear, but it is presumed by the inventors of the present invention that, since the chelating activity of the poly-α-hydroxyacrylic acid compounds has a different intensity from that of the organic phosphonic acid compounds, the hydrogen peroxide can be allowed to penetrate and reach the inside of the fiber material without decomposition thereof by the strong stabilizing effect of the poly-α-hydroxyacrylic acid compound, and the hydrogen peroxide is activated by the action of the organic phosphonic acid compound.

The above-mentioned effects are exhibited at an unexpectedly high intensity by a synergistic effect of the poly-α-hydroxyacrylic acid compound and the organic phosphonic acid compound of the formula (1) or (2).

In the stabilizer of the present invention, the hydroxyacrylic acid polymer component (A) and the organic phosphonic are acid component (B) preferably contained in a mixing weight ratio of from 100:1 to 1:50, more preferably from 9:1 to 1:4.

The poly-α-hydroxyacrylic acids which are water-soluble, and water-soluble salts thereof and corresponding polylactones thereto, have a chelating activity and can produce complex salts with metal ions. These compounds also exhibit a sequestering effect on various types of metal ions. The poly-α-hydroxyacrylic acid compounds usable for the present invention preferably have a molecular weight of from 1,000 to 1,000,000, more preferably from 2,000 to 800,000.

The water soluble salts of poly-α-hydroxyacrylic acids are preferably selected from monovalent metal salts, for example, alkali metal salts including sodium salts and potassium salts, and ammonium salts thereof. The polylactone (PLAC) corresponding to the poly-α-hydroxyacrylic acids (PLAC) have intramolecular or intermolecular ester groups formed by intramolecular or intermolecular reactions of carboxyl groups with hydroxyl groups in the poly-α-hydroxyacrylic acid compound molecules.

Usually, the hydroxyacrylic acid polymer component (A) is used in an amount of 0.05 g/l or more, preferably, 0.2 g/l or more, in a hydrogen peroxide bleaching solution. Note, although there is no specific upper limit of the concentration of the hydroxyacrylic acid polymer component (A), the hydroxyacrylic acid polymer component (A) is usually used in an amount not exceeding 10 g/l.

The organic phosphonic acids of the formulae (1) and (2), and salts, particularly water-soluble salts, thereof, have a chelating activity and can produce complex salts with metal ions and exhibit a buffering effect.

The salts of organic phosphonic acids usable for the present invention are selected from water-soluble salts thereof, for example, monovalent metal salts, especially alkalic metal salts including sodium salts and potassium salts, and ammonium salts.

The organic phosphonic acids of the formula (1) are preferably selected from methylene-1,1-diphosphonic acid, ethylidene-1,1-diphosphonic acid, butylidene-1,1-diphosphonic acid, 1-hydroxyethylidene-1,1-diphosphonic acid, and 1-hydroxypropylidene-1,1-diphosphonic acid.

The organic phosphonic acids of the formula (2) are preferably selected from amino,-tri(methylenephosphonic acid) which corresponds to a compound of the formula (2) in which $\underline{n}=0$, ethylenediamine-tetra(methylenephosphonic acid) which corresponds to a compound of the formula (2) in which $\underline{n}=1$, diethylenetriamine-penta(methylenephosphonic acid) which corresponds to a compound of the formula (2) in which $\underline{n}=2$, and triethylenetetraminehexa(methylenephosphonic acid) which corresponds to a compound of the formula (2) in which $\underline{n}=3$. Preferably, the organic phosphonic acids of the formula (2) in which $\underline{n}$ is 0.1 or 2 are used. The organic phosphonic acid component (B) is preferably contained in an amount of from 0,2 to 5 g/l, more preferably from 0.3 to 2 g/l, in the hydrogen peroxide bleaching liquid.

The stabilizer of the present invention is preferably added in an amount of 0.25 to 15 g/l to a hydrogen peroxide aqueous solution, to provide a bleaching solution.

A fiber material to be bleached is brought into contact with the bleaching solution and is heated at a desired temperature of from room temperature to a boiling point temperature of the bleaching liquid. The bleaching solution may contain a usual additive for example, a surfactant, in a usual manner. The fiber material to be bleached are usually selected from cotton, hemp, flax, and regenerated cellulose fiber materials. However, the fiber material may be another fiber material, for example, blend materials of cellulosic fibers, for example, cotton fibers, with synthetic fibers, for example, polyester fibers.

The bleaching solution containing the stabilizer of the present invention can be used in any type of bleaching machines, for example, non-continuous (batch type) bleaching machines including winch type, Kier type, Obermaier type, and jigger type bleaching machines, and continuous bleaching machines including J-box type, L-box type, Perble Range type, and Benteler type bleaching machines. Especially, the stabilizer of the present invention is suitable for the continuous bleaching machines in which the bleaching solution is used in a small liquor ratio.

SPECIFIC EXAMPLES

The present invention will be further explained by way of specific examples, which, however, are representative and do not restrict the scope of the present invention in any way.

In the examples, the brightness and stiffness of bleached fabric were determined as follows. Stiffness represents a touch of the fabric.

(1) Whiteness

The whiteness of a fabric was determined by measuring a light reflection on the fabric surface at a wave length of 440 m μm by a Macbeth Colorimeter MS-2020 (Trademark).

(2) Stiffness

The stiffness of a fabric was represented by a resistance in 8 unit of a fabric swatch having a length of 10 cm and a width of 10 cm when the swatch was forced to pass through a stainless steel ring having an inside diameter of 3 cm and a thickness of 0.5 mm by a tensile testing machine (Trademark: Tensilon UTM-III-100, made by Toyo Baldwin Co.).

EXAMPLES 1 to 4 and COMPARATIVE EXAMPLES 1 to 5

In each of the above-numbered examples and comparative examples, a bleaching solution was prepared from 40 ml of a 35% hydrogen proxide aqueous solution, a stabilizer having the composition and amount as shown in Table 1, 1 g/l of a surfactant (which was a mixture of an anionic surfactant and a non-ionic surfactant and was available under a trademark of Sunmol S-50, made by Nikka Chemical Industry Co., Ltd.) and 3 g/l of sodium hydroxide flakes.

A knitted fabric made of cotton yarn having a yarn count number of 40 was immersed in the bleaching solution, was squeezed at a pick up of 100% based on the weight of the cotton fabric, and was heated with steam at a temperature of 100° C for 40 minutes in a high pressure steaming type bleaching machine.

The bleached fabric exhibited the whiteness and touch as shown in Table 1.

As Table 1 clearly shows, the bleached fabrics in Examples 1 to 4 had a satisfactory whiteness and touch.

TABLE 1

| | Item | Example No. | | | | | | | | |
|---|---|---|---|---|---|---|---|---|---|---|
| | | Comparative Example | | | | | Example | | | |
| | | 1 | 2 | 3 | 4 | 5 | 1 | 2 | 3 | 4 |
| Stabilizer | Sodium silicate (Grade No. 3) (g/l) | 10 | — | — | — | — | — | — | — | — |
| | PHAS (*)$_1$ (g/l) | — | 1 | 2 | — | 1 | 0.5 | 0.5 | 0.5 | |
| | PLAC (*)$_2$ (g/l) | — | — | — | — | — | — | — | — | 0.5 |
| | Sodium pyrophosphate (g/l) | — | — | — | — | 3 | — | — | — | — |
| | 1-Hydroxyethylidene-1,1-diphosphonic acid (g/l) | — | — | — | 3 | — | 0.5 | — | — | 0.5 |
| | Pentasocium aminotri-(methylenephosphonate) (g/l) | — | — | — | — | — | — | 0.5 | — | — |
| | Ethylenediamine tetra-(methylenephosphonic acid) (g/l) | — | — | — | — | — | — | — | 0.5 | — |
| Property | Whiteness (%) | 88.4 | 88.5 | 89.4 | 86.1 | 89.0 | 90.5 | 90.4 | 90.8 | 90.1 |
| | Touch (Stiffness) (g) | 58 | 42 | 45 | 38 | 51 | 41 | 40 | 42 | 40 |

Note:
(*)$_1$ - PHAS was sodium poly-α-hydroxyacrylate which was produced by reacting PLAC with NaOH.
(*)$_2$ - PLAC was a polylactone of poly-α-hydroxyacrylate having an average molecular weight of 100,000, and available under a trademark of Clarene-L, made by Solvay Co.

EXAMPLES 5 to 8 and COMPARATIVE EXAMPLES 6 to 9

In each of the above-numbered examples and comparative examples, a bleaching solution was prepared from 20 g/l of a 35% hydrogen peroxide aqueous solution, a stabilizer having the composition and amount as indicated in Table 2, 1 g/l of Sunmol S-50, and 2 g/l of sodium hydroxide flakes.

A cotton plain weave fabric (Broad cloth) consisting of cotton yarn having a yarn count number of 40 was impregnated with 90%, based on the weight of the fabric, of the bleaching solution, and was heated with steam at a temperature of 95° C. for 30 minutes in a bleaching machine.

The resultant breached fabric was subjected to the whiteness test.

Also, the cotton seed-removing effect of the bleaching solution on the cotton fabric was evaluated by naked eye observation into the following classes.

Good: No seeds found in the bleached fabric

Slightly bad: A few seeds found in the bleached fabric

Bad: A large number of seeds found in the bleached fabric.

The results of the test and observation are shown in Table 2.

Table 2 clearly shows that the bleaching liquids of Examples 5 to 8 exhibited a satisfactory bleaching and cotton seed-removing effect.

TABLE 2

| | Item | Example No. | | | | | | | |
|---|---|---|---|---|---|---|---|---|---|
| | | Comparative Example | | | | Example | | | |
| | | 6 | 7 | 8 | 9 | 5 | 6 | 7 | 8 |
| Stabilizer | Sodium silicate (Grade No. 2) (g/l) | 7 | — | — | — | — | — | — | — |
| | Neolate PH-150 (*)$_2$ (g/l) | — | 7 | — | — | — | — | — | — |
| | PHAS (g/l) | — | — | 0.7 | 1.5 | 0.7 | 0.7 | 0.7 | 1.0 |
| | 1-Hydroxyethylidene-1,1-diphosphonic acid (g/l) | — | — | — | — | 0.7 | — | — | — |
| | Aminotri (methylenephosphonic acid) (g/l) | — | — | — | — | — | 0.7 | — | — |
| | Ethylenediamine tetra-(methylenephosphonic acid) (g/l) | — | — | — | — | — | — | 0.7 | 0.5 |
| Property | Whiteness (%) | 84.0 | 84.2 | 84.5 | 85.8 | 86.0 | 86.1 | 85.9 | 86.3 |
| | Cotton seed-removing effect | Good | Good | Bad | Slightly bad | Good | Good | Good | Good |

Note:
(*)$_3$ - Neolate PH-150: Trademark of a low silicate type stabilizer made by Nikka Chemical Industry Co.

EXAMPLES 9 to 13

In each of the above-numbered examples, the same procedures as those described in Example 1 were carried out except that the stabilizer had the composition and amount as shown in Table 3.

The organic phosphonic acid compounds and poly-α-hydroxyacrylic acid compounds were in the form of potassium or ammonium salts.

The bleaching results for the cotton knitted fabric are shown in Table 3.

Table 3 clearly shows that the bleaching solution of Examples 9 to 13 exhibited on excellent bleaching and brightening effect without degrading the touch of the bleached fabrics.

TABLE 3

| | Item | Example No. 9 | 10 | 11 | 12 | 13 |
|---|---|---|---|---|---|---|
| | PHAP (g/l) (*)4 | 0.5 | 0.5 | 0.5 | — | — |
| | PHAA (g/l) (*)5 | — | — | — | 0.5 | 0.5 |
| | 1-Hydroxyethylidene-1,1-diphosphonic acid (g/l) (*)6 | 0.5 | — | — | 0.5 | — |
| | Hexamethylenediamine-tetra (methylene-phosphonic acid) (g/l) (*)7 | — | 0.5 | — | — | 0.5 |
| | Diethylenetriamine-penta (methylene-phosphonic acid) (g/l) (*)8 | — | — | 0.5 | — | — |
| Property | Whiteness (%) | 90.3 | 90.4 | 90.3 | 90.1 | 90.4 |
| | Touch (Stiffness) (g) | 41 | 41 | 40 | 40 | 41 |

Note:
(*)4 - PHAP: Poetaaium poly-αhydroxyacrylate
(*)5 - PHAA: Ammonium poly-α-hydroxyacrylate
(*)6 - sodium salt
(*)7 - sodium salt
(*)8 - sodium salt

EXAMPLES 14 to 16 and COMPARATIVE EXAMPLES 10 to 12

In each of the above-numbered examples and comparative examples, two pieces of a cotton poplin cloth were scoured in an ordinary manner, were impregnated separately with a 1% $FeSO_4.7H_2O$ aqueous solution and with a 1% $CuSO_4.5H_2O$ aqueous solution in an amount of 250 g/m$^2$, and then dried.

The ion salt-containing and copper salt-containing pieces of the fabric were bleached, separately from each other, in the same manner as described in Example 9, except that the stabilizer used had the composition and amount as indicated in Table 4.

The bleached pieces of the fabric were subjected to a tensile test by using an autograph tensile test machine (a constant speed tension test), in which a specimen gripped with a pair of grips spaced 5 cm from each other was stretched at a stretching speed of 200 mm/min. The tensile strength of the specimen was indicated by an average value of fine measurements in each of the warp and weft directions.

The result of the tensile test of the bleached fabric is shown in Table 4.

Table 4 clearly shows that the bleached fabrics in Examples 14 to 16 exhibited satisfactory tensile strength in the warp and weft directions thereof, even though the bleaching procedures were carried out in the presence of heavy metal ions, that is, iron ions ($Fe^{++}$) or copper ions ($Cu^{++}$).

TABLE 4

| | Item | | Example No. Comparative Example 10 | 11 | 12 | Example 14 | 15 | 16 |
|---|---|---|---|---|---|---|---|---|
| Stabilizer | Sodium silicate (Grade No. 3) (g/l) | | 10 | — | — | — | — | — |
| | PHAS (g/l) | | — | 1 | 2 | 0.7 | 0.7 | 0.7 |
| | 1-Hydroxyethylidene-1,1-diphosphonic acid (g/l) | | — | — | — | 0.5 | — | — |
| | Pentasodium aminotri-(methylenephosphonate) (g/l) | | — | — | — | — | 0.5 | — |
| | Ethylenediamine tetra (methylene phosphonic acid (g/l) | | — | — | — | | | 0.5 |
| Tensile strength (kg/10 mm) | $Fe^{++}$ | Warp | 17.0 | 20.0 | 21.0 | 21.5 | 22.0 | 21.8 |
| | | Weft | 8.4 | 10.4 | 10.5 | 11.2 | 10.9 | 11.8 |
| | $Cu^{++}$ | Warp | 13.5 | 15.0 | 16.5 | 17.1 | 16.9 | 17.3 |
| | | Weft | 4.5 | 5.5 | 5.8 | 7.0 | 7.1 | 6.9 |

We claim:

1. A method of bleaching a cellulosic fiber material with hydrogen peroxide, comprising:

(a) impregnating a cellulosic fiber material with an aqueous bleaching solution containing hydrogen peroxide and a stabilizer comprising:

(i) 1 to 100 parts by weight of at least one hydroxyacrylic acid polymer selected from the group consisting of poly-α-hydroxyacrylic acids, and salts thereof and polylactone corresponding thereto; and (ii) 1 to 50 parts by weight of at least one organic phosphate acid compound selected from the group consisting of methylene 1,1-diphosphonic acid, ethylidene-1,1-diphosphonic acid, butylidene-1,1-disphosphonic acid, 1-hydroxyethylidene-1,1-diphosphonic acid, 1-hydroxypropylidene-1,1-diphosphonic acid, amino-tri(methylenephosphonic acid), hexamethylene diamine tetra(methylenephosphonic acid), triethylenetetramine hexa(methylenephosphonic acid), and salts of the above-mentioned organic phosphonic acids, and (b) heating the impregnated cellulosic fiber material with steam.

2. The method as claimed in claim 1, wherein the stabilizer in the aqueous bleaching solution is in an amount of 0.25 to 15 g/l.

3. The method as claimed in claim 1, wherein the poly-α-hydroxyacrylic acids in the stabilizer have a molecular weight of from 1,000 to 1000,000.

4. The method as claimed in claim 1, wherein the poly-α-hydroxyacylic acid salts in the stabilizer are selected from monovalent metal salts and ammonium salts thereof.

5. The stabilizer as claimed in claim 1, wherein the salts of organic phosphonic acids in the stabilizer are selected from monovalent metal salts and ammonium salts thereof.

* * * * *